US009605829B2

(12) United States Patent
Kuo et al.

(10) Patent No.: US 9,605,829 B2
(45) Date of Patent: Mar. 28, 2017

(54) VEHICULAR LAMP

(71) Applicant: MIN HSIANG CORPORATION, Tainan (TW)

(72) Inventors: Yao-Yuan Kuo, Tainan (TW); Shang-Kuei Tai, Taipei (TW); Jui-Hung Hung, Tainan (TW)

(73) Assignee: MIN HSIANG CORPORATION, Tainan (TW)

( * ) Notice: Subject to any disclaimer, the term of this patent is extended or adjusted under 35 U.S.C. 154(b) by 181 days.

(21) Appl. No.: 14/548,718

(22) Filed: Nov. 20, 2014

(65) Prior Publication Data

US 2016/0146422 A1 May 26, 2016

(51) Int. Cl.
*F21V 7/00* (2006.01)
*F21S 8/10* (2006.01)

(52) U.S. Cl.
CPC ..... *F21S 48/328* (2013.01); *F21S 48/1104* (2013.01); *F21S 48/1159* (2013.01); *F21S 48/15* (2013.01); *F21S 48/335* (2013.01)

(58) Field of Classification Search
CPC .. F21S 48/115; F21S 48/1154; F21S 48/1159; F21S 48/1109
USPC ..... 362/516, 520, 548
See application file for complete search history.

(56) References Cited

U.S. PATENT DOCUMENTS

2003/0063476 A1* 4/2003 English ..... B60Q 1/2696 362/545
2011/0157891 A1* 6/2011 Davis ..... B29C 45/14467 362/244
2011/0279007 A1* 11/2011 Kishimoto ..... B60Q 1/0011 313/45
2011/0280033 A1* 11/2011 Kishimoto ..... F21S 48/1145 362/543
2014/0160780 A1* 6/2014 Puente ..... F21S 48/1104 362/516

OTHER PUBLICATIONS

Katie Gerard, "13 high performance plastics used in the automotive industry", Jul. 15, 2014, Craftech industries.*

* cited by examiner

*Primary Examiner* — Anh Mai
*Assistant Examiner* — Matthew Peerce

(57) ABSTRACT

A vehicular lamp includes a housing having a chamber. The housing includes a heat dissipating portion made of metal. The housing further includes a platform integrally formed with the heat dissipating portion. The platform includes a coupling portion. A reflective cover is mounted in the chamber and includes a recessed portion in. The recessed portion has a rear end with an opening. The platform extends through the opening, and the coupling portion is received in the recessed portion. The recessed portion includes a reflective face. A light-emitting diode unit includes a plurality of light-emitting diodes fixed to the coupling portion and a circuit board fixed to the coupling portion. The light-emitting diodes emit light rays towards the reflective face of the reflective cover. A shield is mounted in front of the housing and is transmittable to the light rays.

12 Claims, 5 Drawing Sheets

VEHICULAR LAMP

BACKGROUND OF THE INVENTION

The present invention relates to a vehicular lamp and, more particularly, to a vehicular lamp that uses a light-emitting diode light source to permit easy control the set lighting pattern, to provide enhanced heat dissipating effect, to reduce the weight, and to increase the sense of quality after assembly.

Vehicular lamps have been developed from conventional halogen lamps to high-intensity discharge (HID) lamps and then to light-emitting diode (LED) lamps. LED lamps for vehicles do not include stabilizers required in HID lamps and consume less energy while having the advantages of small volume, light weight, high on/off speed, excellent resistance to vibration, and long service life.

However, LED lamps must work in a suitable temperature condition to provide reliable use. The emitting efficiency of LED chips deteriorates at high temperature which even damages the LED chips. The working temperature for LED chips is preferably below 80° C. Thus, highly efficient heat dissipation of the LED lamps is the key factor of smooth operation of the LED lamps.

Conventional vehicular lamps include LEDs, a reflective cover, and a housing. The housing is preferably made of metal with good strength and thermal dissipation properties. The housing includes a recessed portion in a center thereof. A light-transmittable shield is mounted in front of the recessed portion. The reflective cover is mounted in the recessed portion of the housing and includes an inner recessed portion with a reflective face. The LEDs are mounted in the inner recessed portion such that the light rays emitted by the LEDs can be reflected by the reflective face and then transmit the housing to present a set lighting pattern.

The LEDs are generally fixed on a cooling block for cooling purposes. The cooling block is coupled to the housing such that the heat generated by the LEDs can indirectly be conducted by the cooling block to the housing for dissipating the heat. However, the indirect heat conduction causes a loss in the heat dissipating efficiency. Although the housing can protect the reflective cover, the vehicular lamp has a larger weight due to the heavy metal housing, which is disadvantageous to reduction of the weight of the vehicle and to the energy-saving demand.

BRIEF SUMMARY OF THE INVENTION

The primary objective of the present invention is to provide an LED vehicular lamp with enhanced heat dissipating effect.

Another objective of the present invention is to provide a vehicular lamp with a reduced weight and an energy-saving effect.

A vehicular lamp according to the present invention includes a housing having a chamber. The housing includes a heat dissipating portion made of metal. The housing further includes a platform extending from a rear end to a front end of the housing and integrally formed with the heat dissipating portion. The platform includes a coupling portion. A reflective cover is mounted in the chamber of the housing and includes a recessed portion in a center thereof. The recessed portion has a rear end with an opening. The platform extends through the opening, and the coupling portion is received in the recessed portion. The recessed portion includes a reflective face. A light-emitting diode unit includes a plurality of light-emitting diodes fixed to the coupling portion and a circuit board fixed to the coupling portion. The plurality of light-emitting diodes is adapted to emit light rays towards the reflective face of the reflective cover. A shield is mounted in front of the housing and is transmittable to the light rays.

The housing can include a rear portion and a front portion. The rear portion forms the heat dissipating portion. The front portion can be made of a material having a specific weight smaller than a specific weight of a material for the rear portion.

The front portion can be made of plastic.

The housing can further include a rear shell plate having a front face and a rear face. The rear shell plate further includes an outer edge having a coupling ridge. A plurality of fins is provided on the rear face. The platform is integrally formed with the front face of the rear shell plate. The front portion includes a concave structure and having a peripheral wall. The peripheral wall includes a rear end having a slot through which the platform extends. The slot includes a peripheral edge having a rear coupling side. The rear coupling side is coupled with the coupling ridge of the rear portion. The front portion and the rear portion are coupled to each other to form the chamber in a center of the housing. The platform is located in the chamber.

The peripheral wall of the front portion can include a vent, and a watertight air-permeable plug is received in the vent.

The rear portion of the housing can include a through-hole. The circuit board of the light-emitting diode unit is connected to a wire extending out of the housing via the through-hole. The coupling portion includes a groove in which the circuit board is received. A stop plate is mounted in front of the coupling portion. The circuit board is covered by a sealing glue.

The vehicular lamp can further include a cover covering the platform.

The platform can include an upper portion and a lower portion. The coupling portion is provided on each of the upper and lower portions. The plurality of light-emitting diodes includes two light-emitting diodes. Each of the two light-emitting diodes is mounted on the coupling portion on one of the upper and lower portions. The cover is mounted in front of the platform of the housing. The cover includes a front board, an upper board, and a lower board. The front board, the upper board, and the lower board together define a coupling groove in which the platform is received. A through-slot is defined in each of the upper board and the lower board in a location corresponding to one of the two light-emitting diodes.

The vehicular lamp according to the present invention can be used as a head light, a fog light, or a working light. When the light-emitting diodes of the light-emitting diode unit emit light rays, the light rays pass through the through-holes, are reflected by the reflective face of the reflective cover, and transmit the shield to output a set lighting pattern of a high beam or a low beam. The heat generated by the light-emitting diode unit can directly be conducted to the platform integrally formed with the rear portion of the housing without the need of an additional heat conducting member. The heat dissipating efficiency is improved, and the service life of the light-emitting diodes is prolonged.

The front portion of the housing is made of a material having a specific weight smaller than a specific weight of a material for the rear portion. Thus, the overall weight of the vehicular lamp can be effectively reduced, which is helpful in reducing the weight of the vehicular body and in saving fuel. Furthermore, the platform is covered by the cover to provide a sense of quality as viewed from a front of the vehicular lamp.

The present invention will become clearer in light of the following detailed description of illustrative embodiments of this invention described in connection with the drawings.

DETAILED DESCRIPTION OF THE INVENTION

Figure 1:
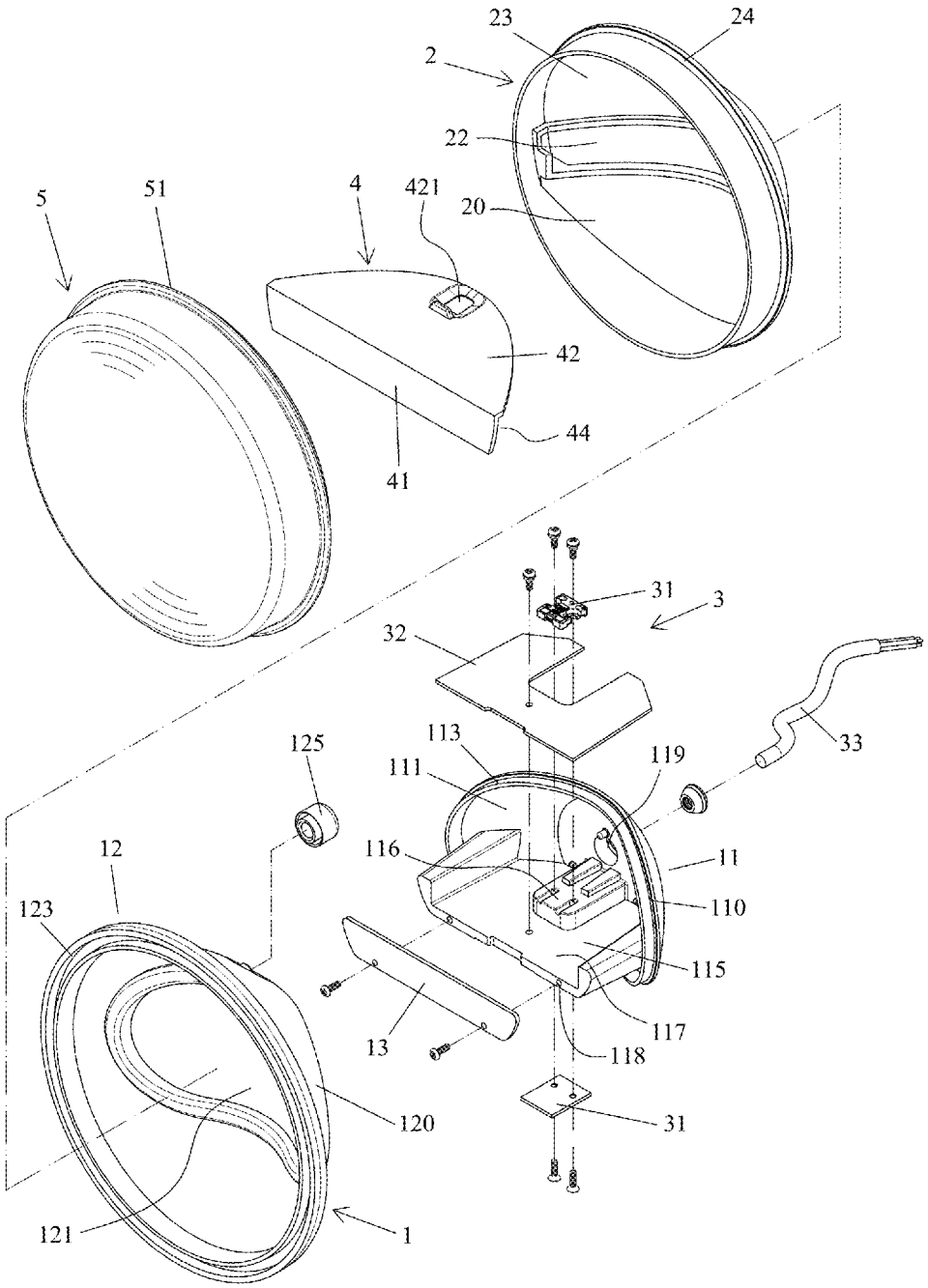
FIG. 1 is an exploded, perspective view of a vehicular lamp according to the present invention.
Figure 2:
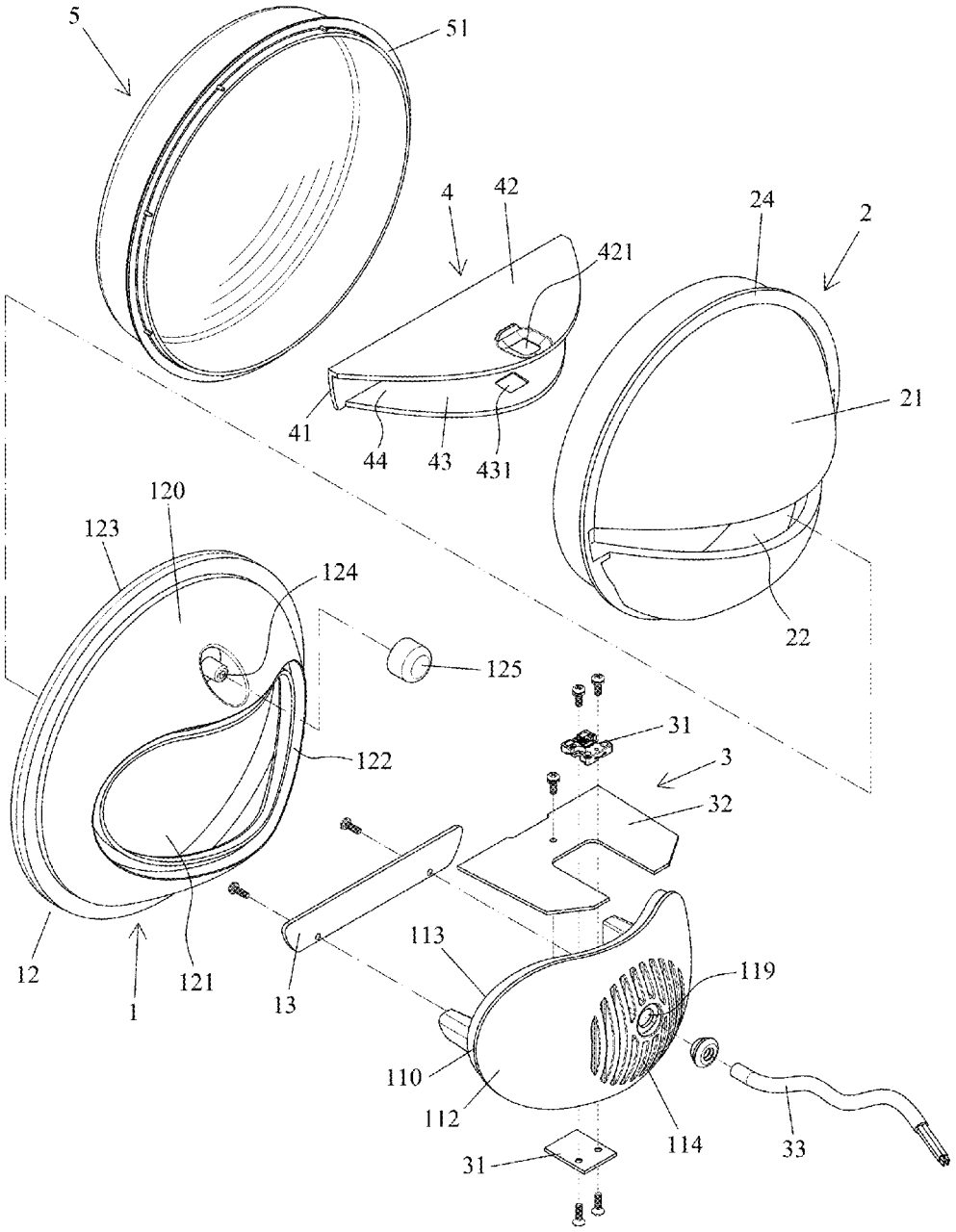
FIG. 2 is another exploded, perspective view of the vehicular lamp of FIG. 1.
Figure 3:
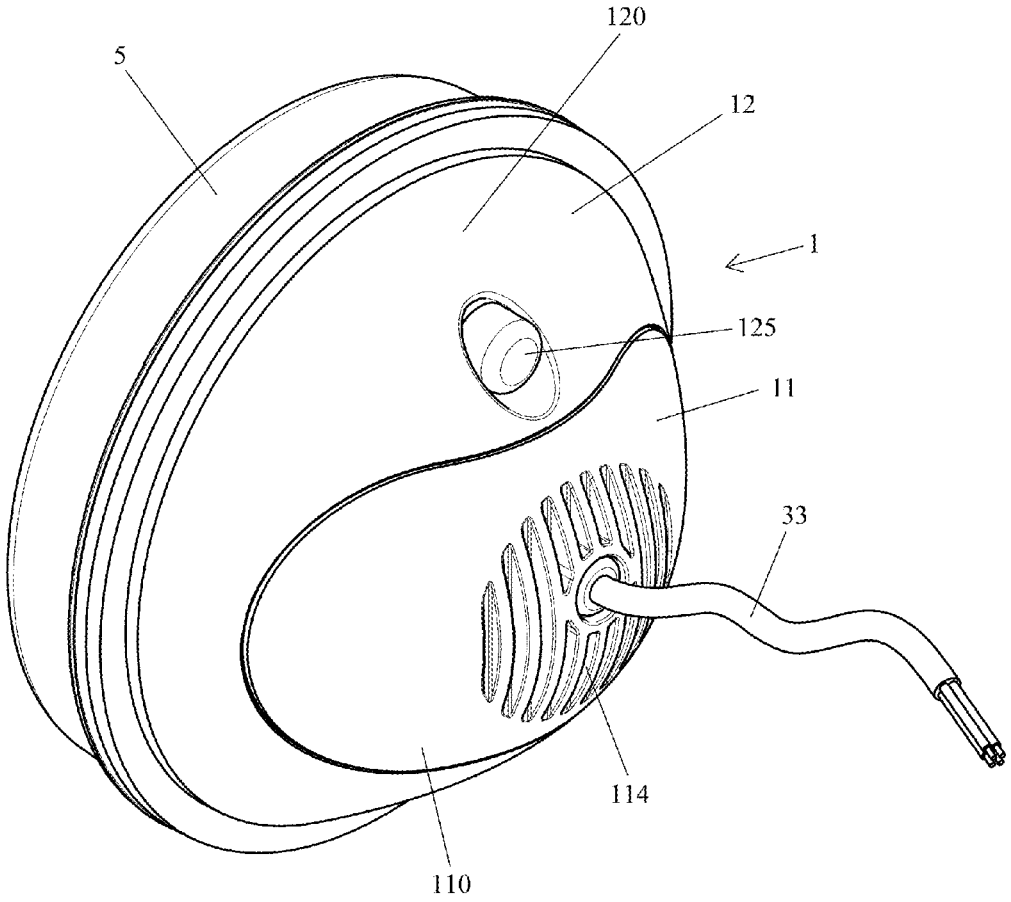
FIG. 3 is a perspective view of the vehicular lamp of FIG. 1.
Figure 4:
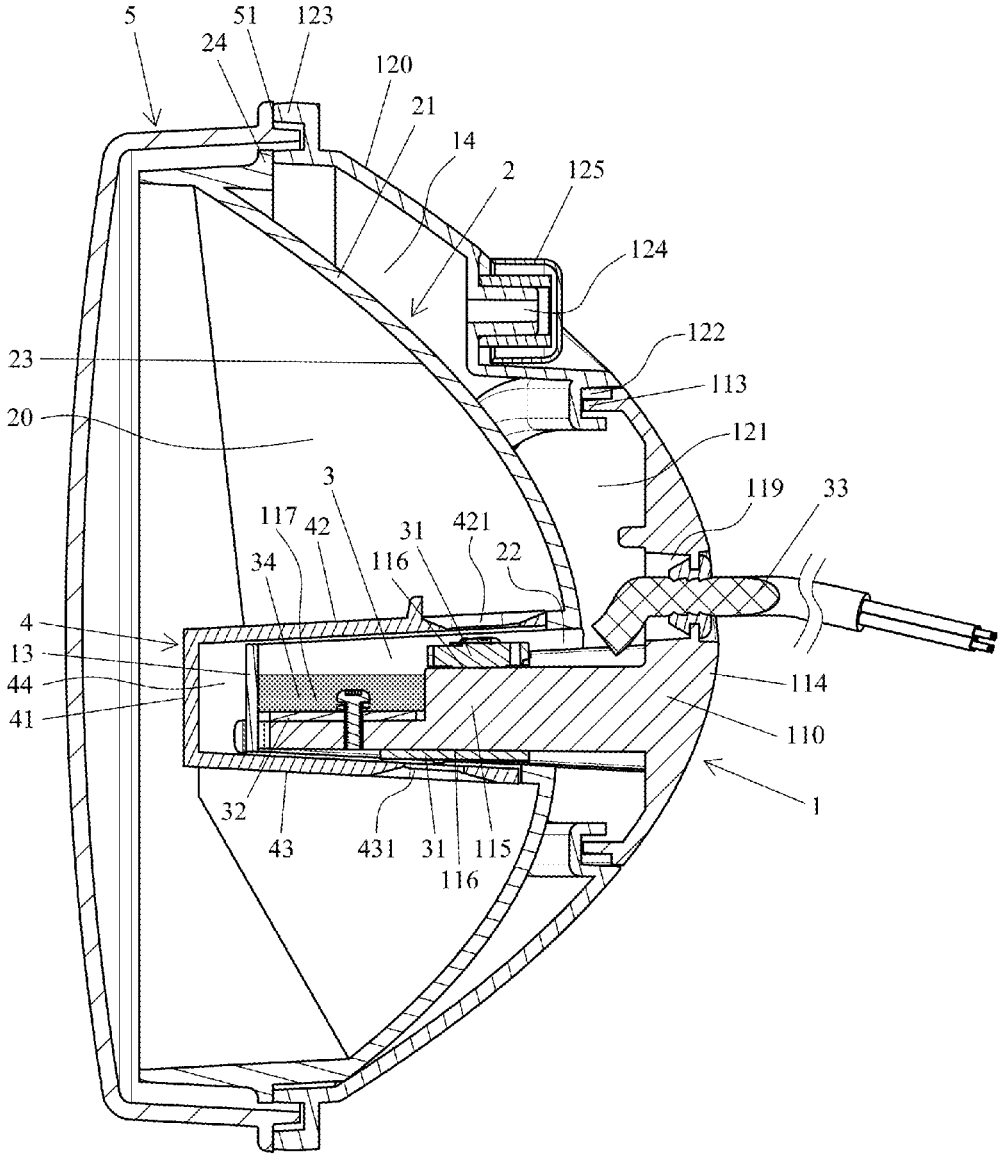
FIG. 4 is a cross sectional view of the vehicular lamp of FIG. 1.

With reference to FIGS. 1-4, a vehicular lamp according to the present invention is in the form of a head lamp and includes a housing 1, a reflective cover 2, a light-emitting diode unit 3, a cover 4, and a shield 5. The housing 1 includes a rear portion 11 and a front portion 12. The rear portion 11 is made of metal to form a heat dissipating portion. The rear portion 11 includes a rear shell plate 110. The rear shell plate 110 has a front face 111 and a rear face 112. The rear shell plate 110 further includes an outer edge having a coupling ridge 113. A plurality of fins 114 is provided on the rear face 112. A platform 115 is integrally formed with the front face 111 of the rear shell plate 110 and extends from a rear end to a front end of the housing 1. The platform 115 includes an upper portion and a lower portion. A coupling portion 116 is provided on each of the upper and lower portions. A groove 117 is defined in the coupling portion 116 on the upper portion. The platform 115 includes a front end having a plurality of holes 118 for fixing a stop plate 13. The rear portion 11 includes a through-hole 119. The front portion 12 is made of plastic or other light-weight material. The front portion 12 includes a concave structure and has a peripheral wall 120. The peripheral wall 120 includes a rear end having a slot 121 through which the platform 115 extends. The slot 121 includes a peripheral edge having a rear coupling side 122. The rear coupling side 122 can be coupled with the coupling ridge 113 of the rear portion 11 by glue or any other coupling provision. Furthermore, the front portion 12 and the rear portion 11 are coupled to each other to form a chamber 14 in a center of the housing 1, and the platform 115 is located in the chamber 14. Furthermore, the front portion 12 includes a front end having a front coupling lip 123. The peripheral wall 120 of the front portion 12 further includes a vent 124. A watertight air-permeable plug 125 is received in the vent 124.

The reflective cover 2 is mounted in the chamber 14 of the housing 1. The reflective cover 2 includes a recessed portion 20 in a center thereof. The recessed portion 20 includes a peripheral wall 21 having a rear end with an opening 22. The platform 115 extends through the opening 22, and the coupling portions 116 are received in the recessed portion 20. The peripheral wall 21 of the recessed portion 20 includes a reflective face 23 on an inner side thereof. The peripheral wall 21 further includes a coupling flange 24 on an outer side thereof. The coupling flange 24 can be coupled to the front portion 12 of the housing 1 by glue or any other coupling provision.

The light-emitting diode unit 3 includes two light-emitting diodes 31. Each light-emitting diode 31 is mounted on the coupling portion 116 on one of the upper and lower portions of the platform 115. The light-emitting diode 3 further includes a circuit board 32 fixed in the groove 117 of the platform 115. The light-emitting diodes 31 are adapted to emit light rays towards the reflective face 23 of the reflective cover 2. The circuit board 32 is covered by a sealing glue 34. The stop plate 13 prevents the hardened sealing glue 34 from overflowing out of the groove 117 of the platform 115. The circuit board 32 is connected to a wire 33 that extends out of the housing 1 via the through-hole 119 of the housing 1 to connect with an external electrical member (not shown).

The cover 4 is mounted in front of the platform 115 of the housing 1. The cover 4 includes a front board 41, an upper board 42, and a lower board 43. The front board 41, the upper board 42, and the lower board 43 together define a coupling groove 44 in which the platform 115 is received. A through-slot 421, 431 is defined in each of the upper board 42 and the lower board 43 in a location corresponding to one of the two light-emitting diodes 31. An edge of the cover 4 can be fixed to an end edge of the platform 115 by glue or any other coupling provision.

The shield 5 is mounted in front of the housing 1 and is transmittable to the light rays. The shield 5 includes an outer rim having a coupling ridge 51 coupled with the front coupling lip 123 of the housing 1.

Figure 5:
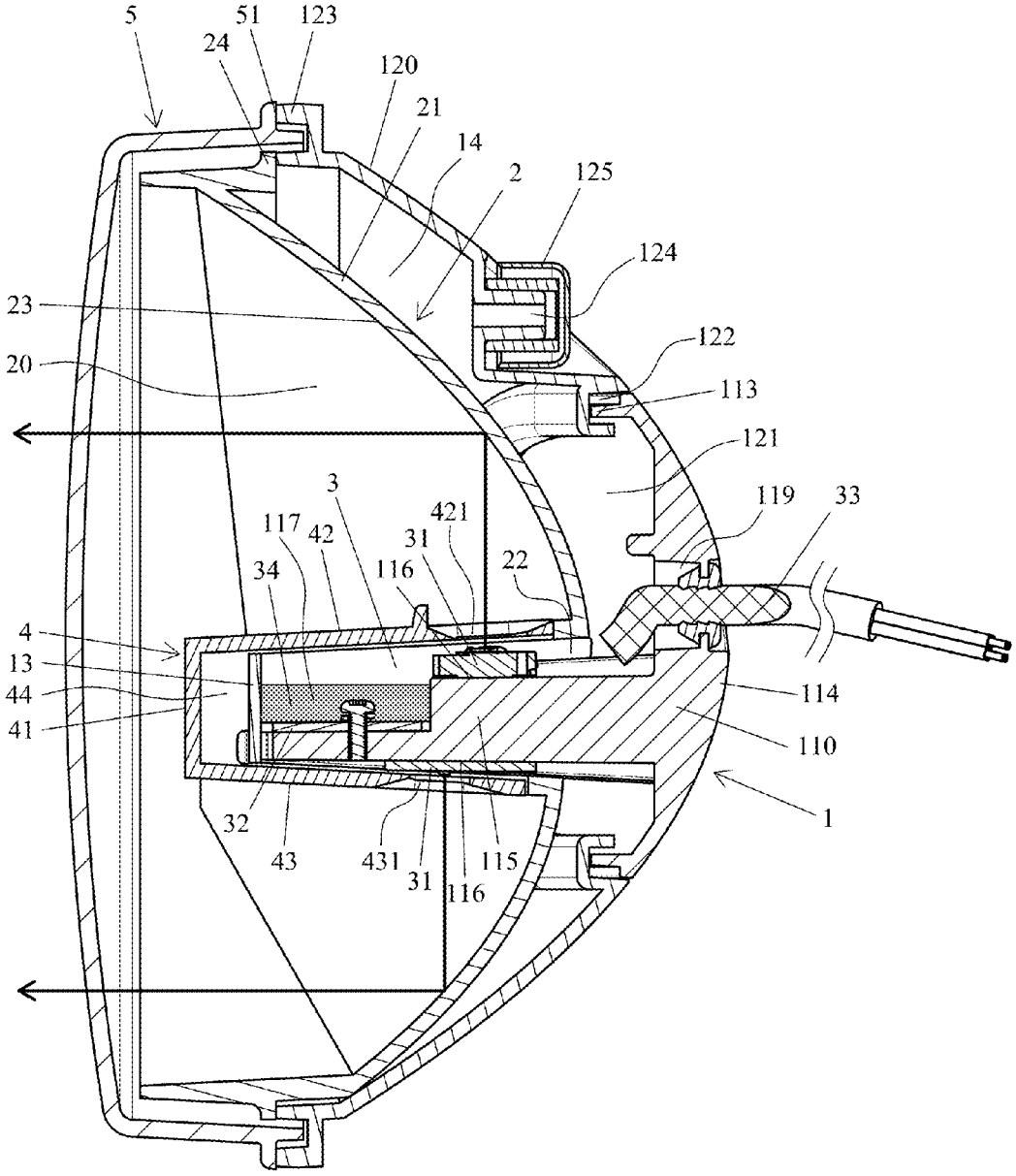
FIG. 5 is a view similar to FIG. 4, illustration operation of the vehicular lamp.

With reference to FIG. 5, when the light-emitting diodes 31 of the light-emitting diode unit 3 emit light rays, the light rays pass through the through-holes 421 and 431, are reflected by the reflective face 23 of the reflective cover 2, and transmit the shield 5 to output a set lighting pattern of a high beam or a low beam. The heat generated by the light-emitting diode unit 3 can directly be conducted to the platform 115 integrally formed with the rear portion 11 of the housing 1 without the need of an additional heat conducting member. The heat dissipating efficiency is improved, and the service life of the light-emitting diodes 31 is prolonged. Furthermore, the vent 124 in the housing 1 can discharge the hot air in the housing 1 to further improve the heat dissipating effect.

The front portion 12 of the housing 1 is made of a material having a specific weight smaller than a specific weight of a material for the rear portion 11. Thus, the overall weight of the vehicular lamp can be effectively reduced, which is helpful in reducing the weight of the vehicular body and in saving fuel. Furthermore, the platform 115 is covered by the cover 4 to provide a sense of quality as viewed from a front of the vehicular lamp.

Although specific embodiments have been illustrated and described, numerous modifications and variations are still possible without departing from the scope of the invention. The scope of the invention is limited by the accompanying claims.

The invention claimed is:

1. A vehicular lamp comprising:

a housing including a chamber, a front portion made of a material of a specific weight A, a rear portion made of a material of a specific weight B, and A<B, the rear portion further including a heat dissipating portion made of metal, and a platform extending from a rear end of the rear portion to a front end of the front portion of the housing and integrally formed with the heat dissipating portion, and with the platform including a coupling portion;

a reflective cover, disposed right in front of the front portion away from the rear portion, and mounted in the chamber of the housing, with the reflective cover including a recessed portion in a center thereof, with the recessed portion having a rear end with an opening, with the platform extending through the opening, with the coupling portion received in the recessed portion, and with the recessed portion including a reflective face;

a light-emitting diode unit including a plurality of light-emitting diodes fixed to the coupling portion and a circuit board fixed to the coupling portion, with the plurality of light-emitting diodes adapted to emit light rays towards the reflective face of the reflective cover; and a shield mounted in front of the housing connecting to the front portion of the housing, with the shield transmittable to the light rays.

2. The vehicular lamp as claimed in claim 1, wherein the front portion is made of plastic.

3. The vehicular lamp as claimed in claim 1, with the housing further including a rear shell plate having a front face and a rear face, with the rear shell plate further including an outer edge having a coupling ridge, with a plurality of fins provided on the rear face, with the platform integrally formed with the front face of the rear shell plate, with the front portion including a concave structure and having a peripheral wall, with the peripheral wall including a rear end having a slot through which the platform extends, with the slot including a peripheral edge having a rear coupling side, with the rear coupling side coupled with the coupling ridge of the rear portion, with the front portion and the rear portion coupled to each other to form the chamber in a center of the housing, and with the platform located in the chamber.

4. The vehicular lamp as claimed in claim 3, with the peripheral wall of the front portion including a vent, and with a watertight air-permeable plug received in the vent.

5. The vehicular lamp as claimed in claim 4, with the rear portion of the housing including a through-hole, with the circuit board of the light-emitting diode unit connected to a wire, with the wire extending out of the housing via the through-hole, with the coupling portion including a groove, with the circuit board received in the groove, with a stop plate mounted in front of the coupling portion, and with the circuit board covered by a sealing glue.

6. The vehicular lamp as claimed in claim 1, further comprising a cover, with the cover covering the platform.

7. The vehicular lamp as claimed in claim 1, further comprising a cover, with the cover covering the platform.

8. The vehicular lamp as claimed in claim 2, further comprising a cover, with the cover covering the platform.

9. The vehicular lamp as claimed in claim 3, further comprising a cover, with the cover covering the platform.

10. The vehicular lamp as claimed in claim 4, further comprising a cover, with the cover covering the platform.

11. The vehicular lamp as claimed in claim 5, further comprising a cover, with the cover covering the platform.

12. The vehicular lamp as claimed in claim 6, with the platform including an upper portion and a lower portion, with the coupling portion provided on each of the upper and lower portions, with the plurality of light-emitting diodes including two light-emitting diodes, with each of the two light-emitting diodes mounted on the coupling portion on one of the upper and lower portions, with the cover mounted in front of the platform of the housing, with the cover including a front board, an upper board, and a lower board, with the front board, the upper board, and the lower board together defining a coupling groove, with the platform received in the coupling groove, and with a through-slot defined in each of the upper board and the lower board in a location corresponding to one of the two light-emitting diodes.

* * * * *